United States Patent [19]

Staniszewski

[11] 4,378,938

[45] Apr. 5, 1983

[54] DOCUMENT STACKING DEVICE

[75] Inventor: Tadeusz Staniszewski, Budd Lake, N.J.

[73] Assignee: Sweda International, Inc., Paramus, N.J.

[21] Appl. No.: 267,153

[22] Filed: May 26, 1981

Related U.S. Application Data

[63] Continuation of Ser. No. 82,459, Oct. 9, 1979, abandoned.

[51] Int. Cl.[3] ..... B65H 31/04; B65H 29/42

[52] U.S. Cl. ..... 271/179; 271/212; 414/94

[58] Field of Search ..... 271/212, 223, 224, 179, 271/113; 414/94, 93, 900, 92, 96, 129; 198/625; 221/260

[56] References Cited

U.S. PATENT DOCUMENTS

| | | | |
|---|---|---|---|
| 2,122,430 | 7/1938 | Long et al. | 271/223 |
| 2,300,863 | 11/1942 | Bamford | 271/179 |
| 3,280,679 | 10/1966 | Huffman | 271/212 X |
| 3,345,064 | 10/1967 | Vandenberg | 271/212 |
| 3,712,487 | 1/1973 | Eberle | 271/179 X |
| 3,837,505 | 9/1974 | Muggli | 414/93 X |
| 3,942,788 | 3/1976 | Boyle | 271/276 X |
| 3,998,141 | 12/1976 | Hsiue | 271/179 X |

*Primary Examiner*—Bruce H. Stoner, Jr.

*Attorney, Agent, or Firm*—Robert F. Rotella; Michael H. Wallach

[57] ABSTRACT

Document stacking device for tags or other documents, which device may comprise counter-rotating helical stacker members, is provided with a gripper mounted thereon for removing the documents from the stacker members. The hopper in which the stacking device stacks the documents is provided with laterally adjustable side walls to accommodate documents of different widths.

9 Claims, 6 Drawing Figures

FIG. 3
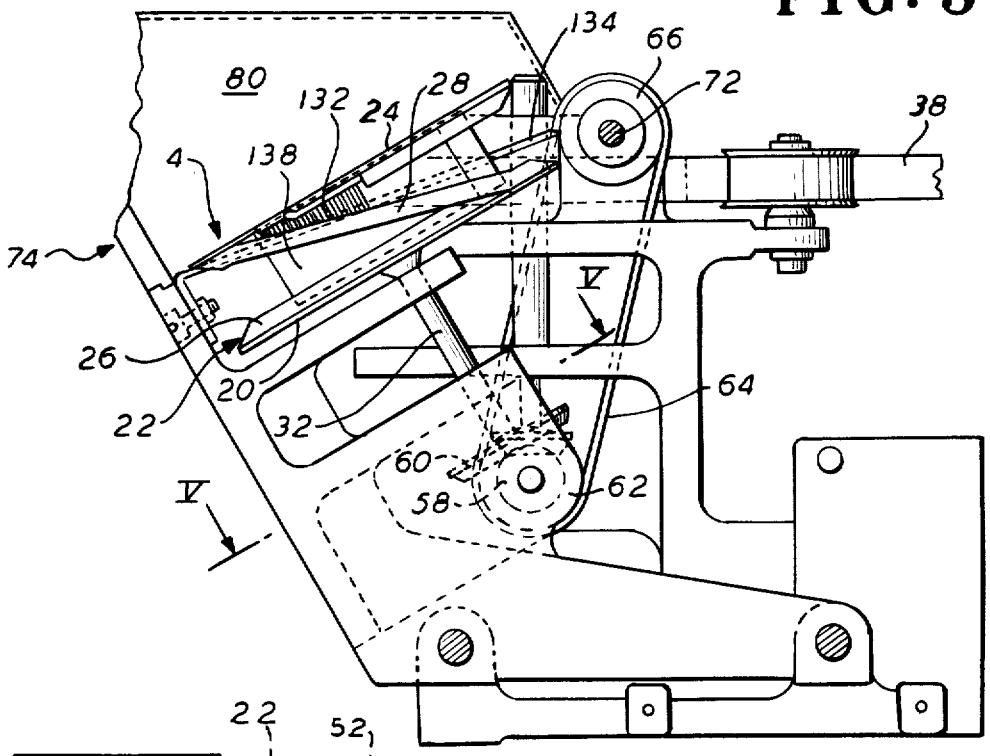
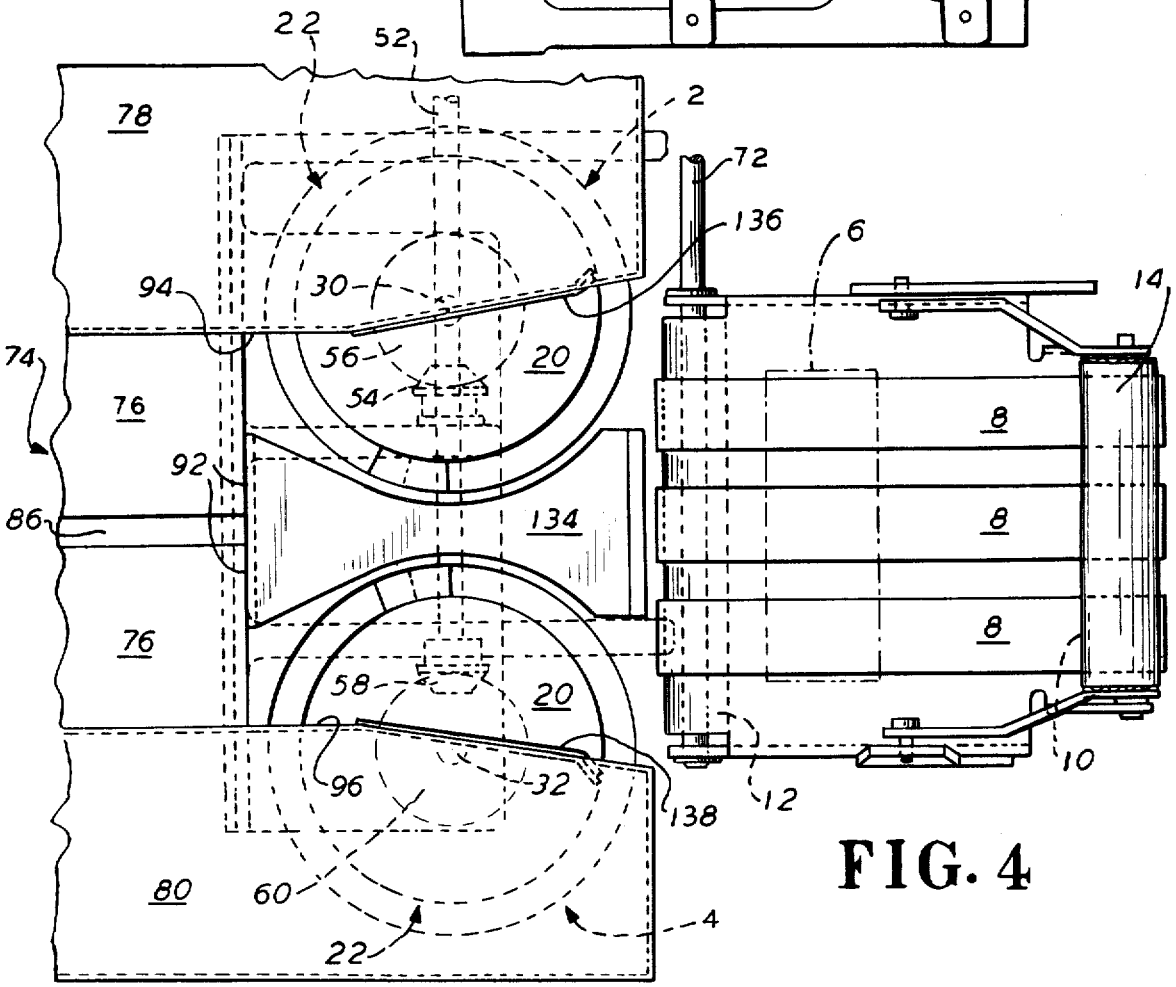
FIG. 4

DOCUMENT STACKING DEVICE

This application is a continuation of application Ser. No. 082,459, filed Oct. 9, 1979, now abandoned.

BACKGROUND OF THE INVENTION

1. Field of the Invention

This invention relates to a document stacking device.

2. Description of the Prior Art

Prior art stacking devices for documents and other articles are shown in U.S. Pat. Nos. 759,719; 1,200,758, 1,210,440; 1,656,285; 2,300,863; 2,778,638; 2,826,413; 3,193,280.

SUMMARY OF THE INVENTION

In accordance with the present invention, there is provided a novel document stacking device, for tags or other documents, in the form of helical stacker members. The latter are provided with gripping means for removing the documents from the stacker.

The helical stacker members are each defined by an annular band configured in the desired helical configuration.

The document hopper into which the stacking means of the invention stacks the documents is provided with laterally movably adjustable side walls to accommodate documents of different widths.

It is one object of the present invention to provide a novel document stacking device.

It is a further object to provide such a stacking device provided with gripping means effective to grip the documents being operated on by the stacking device and remove them therefrom.

It is a further object to provide a novel configuration of a helical stacker member.

It is a further object to provide a novel document hopper into which the document stacking device stacks documents, and in which the hopper is provided with laterally movably adjustable side walls to accommodate documents of different widths.

The above and other objects, advantages, and features of the invention will become apparent to those of ordinary skill in the art from the following detailed description of a specific embodiment of the invention when read in conjunction with the accompanying drawings, in which:

BRIEF DESCRIPTION OF THE DRAWINGS

FIG. 3 is a fragmentary enlarged left side elevational view.

FIG. 4 is a top plan view taken on line IV—IV of FIG. 2.

DETAILED DESCRIPTION OF A SPECIFIC EMBODIMENT

Figure 1:
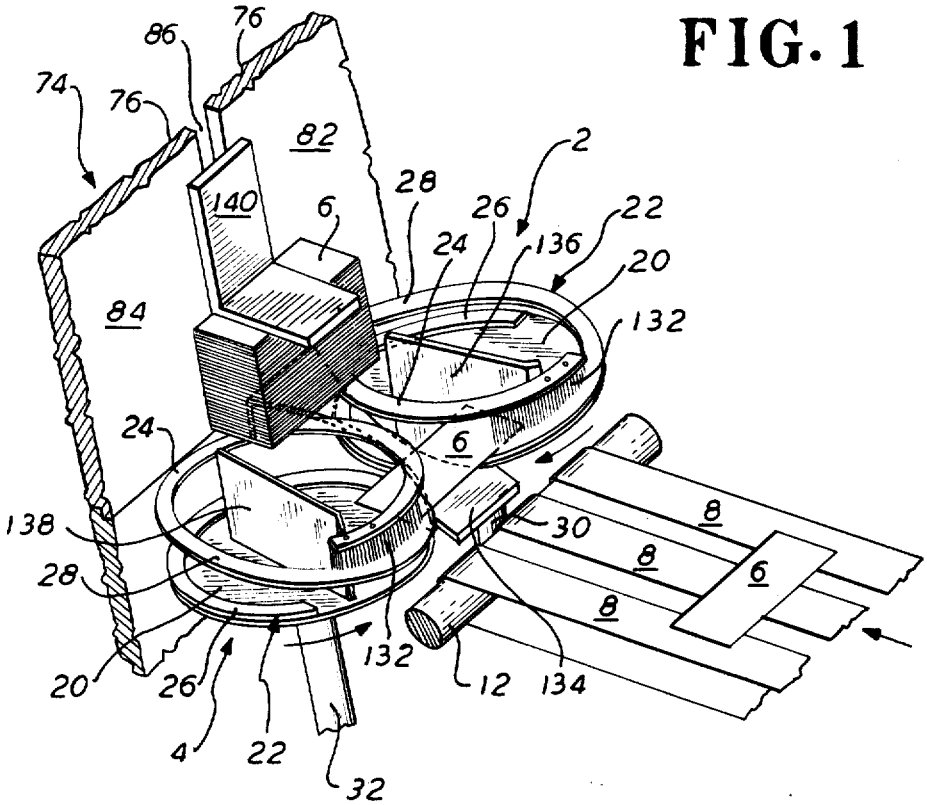
FIG. 1 is an essentially schematic perspective view of the document stacking device of the present invention as embodied in a tag stacker.

In the drawings, and noting especially FIG. 1, there is shown the novel stacking device of the present invention. It basically comprises two adjacent mirror image, counter-rotating, synchronized, right and left-hand cooperating helical members 2 and 4. While the principles of the present invention may be used to stack any one of a variety of sheet-like articles, a present specific application of the invention is for stacking tags or tickets produced, for example, by the document printing machine disclosed in the U.S. patent application Ser. No. 901,869 filed May 1, 1978, now U.S. Pat. No. 4,189,217, and assigned to the same assignee as the present invention. The present stacker is incorporated in the aforesaid machine of Ser. No. 901,869 at the latter's discharge end to stack the tags printed by said machine in a hopper. In that machine, tags are printed from a long web of paper and then are cut into individual tickets, such as price tags to be subsequently attached to merchandise. These tags, designated 6 herein, may be of one part as shown in the present drawings or of more than one part. They are fed at the discharge portion of the tag printing machine to transport belts 8 which in turn feed the tags to the present stacker. Transport belts 8 are mounted at their right and left ends (FIGS. 2, 4) on respective idler and drive rollers 10 and 12. A pinch roller 14 at the right end of the transport belts provides, in conjunction with the belts and their underlying supporting idler roller 10, a nip through which the successive printed and cut tags 6 of the tag printing machine are fed by cooperating feed rollers 16, 18. The transport belts accelerate the tags so as to provide a greater spacing between them than their spacing as they are fed from rollers 16, 18.

Each of tag stacking helical members 2, 4 comprises a substantially flat disk-like bottom plate 20 on which is securely mounted a flat thin flat band 22, of thin sheet steel for example, in the form of an annulus or loop. At its upper and lower ends the loop formed by band 22 has substantially planar circular portions 24, 26. Intermediate and connecting these circular end portions it includes a helical intermediate portion 28, which is approximately one hundred twenty degrees in circumferential extent. The respective helical stacker members 2, 4 are rotatably driven by respective shafts 30 and 32 on which bottom plates 20 are mounted, the left-hand stacker 4 being driven counterclockwise and the right-hand stacker 2 clockwise.

Figure 5:
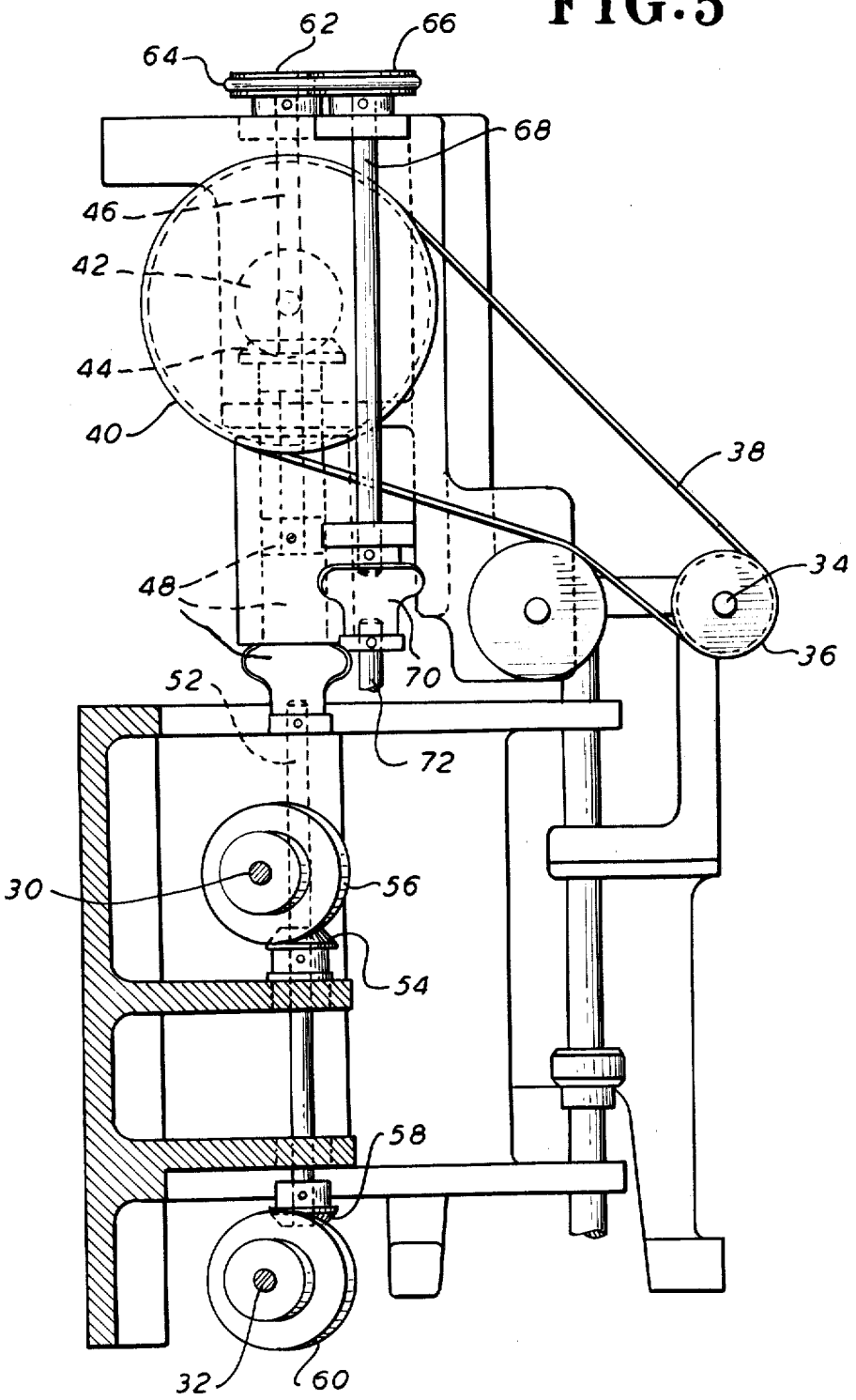
FIG. 5 is a top plan view in section taken on line V—V of FIG. 3 and showing the drive train for the helical stacker members and the tag transport belts which feed the tags to the stacker.

The power trains for the stacker helical members 2, 4 and the transport belts 8 will now be described. Power for these drive trains may be taken from any suitable rotatably driven shaft in the tag printing machine, for example shaft 34 seen in FIG. 5. Through pulley and belt 36, 38 shaft 34 drives large pulley 40. Gear 42 of bevel gear pair 42, 44 is fast with pulley 40, thus driving a shaft 46, which, through a flexible coupling 48, drives a shaft 52. The latter, through spaced bevel gear pairs 54, 56 and 58, 60 drives the respective aforementioned drive shafts 30 and 32 of the two helical stacker members 2 and 4.

Pulley 40 is also utilized to drive the tag transport belts 8. For this purpose there is mounted at the rear end of shaft 46 a pulley 62, which through belt 64 drives an adjacent pulley 66 fast on a shaft 68. The latter is connected through a flexible coupling 70 with a shaft 72 fast with and on which is the mounted the earlier described drive roller 12 on which the tag transport belts 8 are mounted at their left ends. Shaft 72 drives roller 12 which in turn drives belts 8.

The helical stacker of the invention is provided at the base of a tag hopper 74 into which the stacker will stack the tags in a vertically ascending direction.

The hopper comprises a stationary central back wall 76 portion and two opposed laterally movable adjustable side wall members 78 and 80. Back wall 76 comprises two individual wall members 82, 84 spaced to provide therebetween a vertical slot 86. Wall members 82 and 84 are rigidly interconnected by upper and lower brackets 88, 90.

Side wall members 78, 80 are movably adjustable to correspond to whatever particular width (i.e., side-to-side dimension) of tag 6 the tag printing machine is producing. Referring to FIG. 4, the tags when stacked into the tag hopper 74 will have their leftmost long leading edges resting against the vertical surface 92 of the stationary central back wall 76 and their respective rear and front short side edges closely adjacent the corresponding side wall surface portions 94, 96 of adjustable side wall members 78 and 80.

Figure 6:
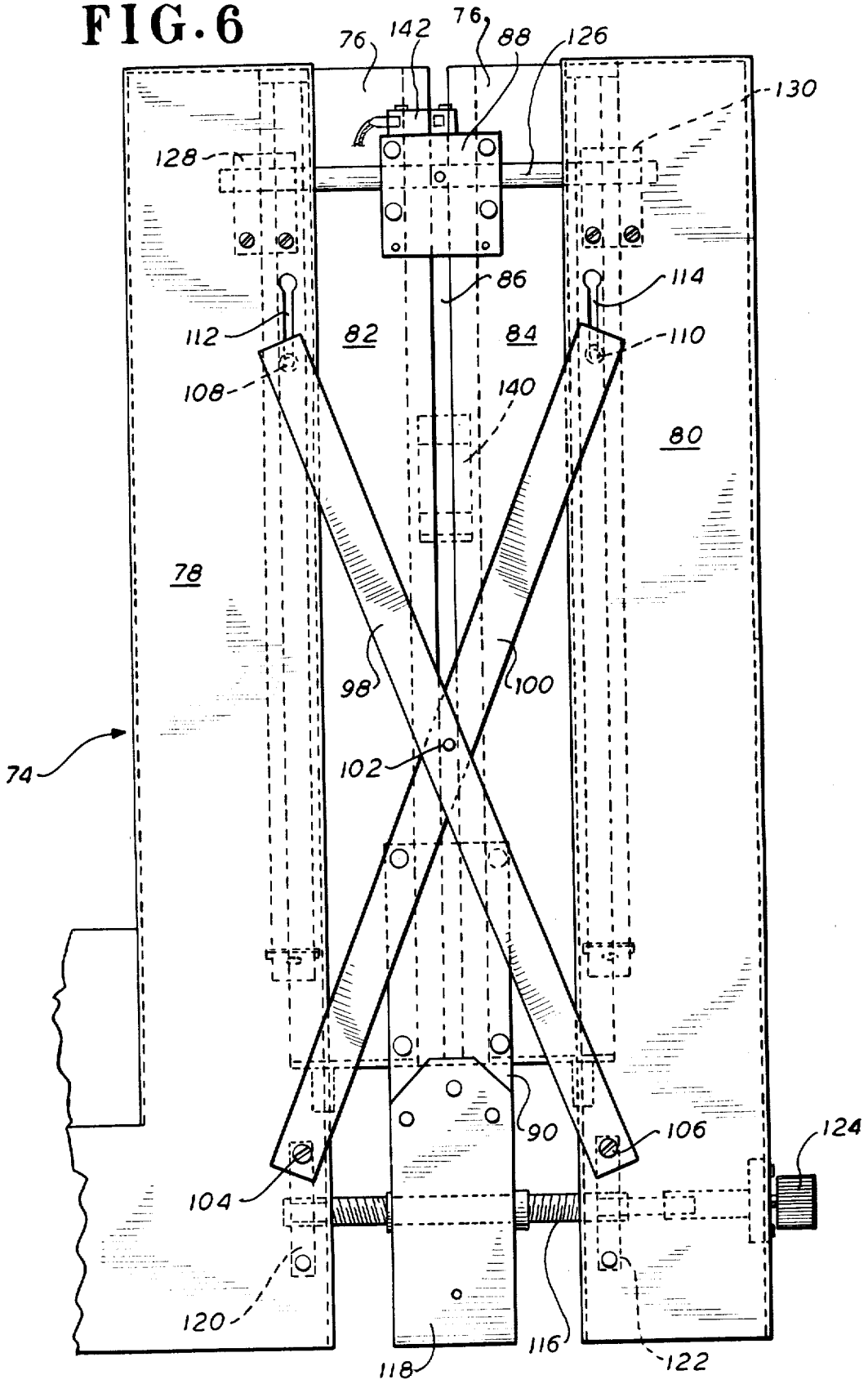
FIG. 6 is a rear elevational view of the tag hopper.

Back wall 76 is mounted in any suitable fashion on the machine framing. How the side wall members 78, 80 are constructed for their lateral adjustability is best seen in the rear elevational view of FIG. 6. A linkage is provided comprising two bars 98, 100 arranged in intersecting X fashion and pivotally connected at their center 102. At their bottom ends the bars are pivotally connected at 104, 106 to the respective side wall members 78, 80. At their upper ends the bars 98, 100 are pivotally connected to pins 108, 110 which ride in vertical slots 112, 114 provided in side wall members 78, 80.

To effect the lateral adjusting movement of the side wall members, there is provided at the lower portion of the tag hopper 74 a shaft 116 which is rotatably supported at its central portion on a depending portion 118 of the lower bracket 90 which holds the back wall members 82, 84 together. At its left and right end portions shaft 116 is threaded in opposite directions. These respective threaded end portions of the shaft are threaded through corresponding threaded holes of bracket members 120, 122 mounted on movable side wall members 78, 80 of the hopper. A manually operable knob 124 is coupled to shaft 116 to rotate the latter. To adjust the side-to-side spacing of the side wall members to provide for tags of different widths, knob 124 is grasped and rotated. Consequent rotary movement of shaft 116 will, by virtue of its being threaded through the side wall bracket members 120, 122, cause the side walls to be shifted toward or away from each other depending on the direction of rotation of the shaft. The X linkage 98, 100 will transmit this lateral side wall movement to the upper portions of the side walls to prevent binding of the latter at their upper ends. At their upper ends the side wall members are supported and guided in any suitable manner for movement on and with respect to the stationary hopper central wall member 76, as by a stationary shaft 126 secured to the upper bracket 88 and extending through and slidably supporting Delrin support members 128, 130 of the side wall members 78, 80.

The angular or circumferential positioning of the mirror image helical stacking members 2, 4 of the tag stacker is such that when each tag 6 is fed to them by transport belts 8, the rising intermediate helical portions 28 of the stacking members have not yet rotated into a position where they will commence engaging the tag and therefore start raising it to be stacked in the hopper. As the stacking members 2, 4 rotate, their rising helical intermediate portions 28 come into contact with the underside of the tag. As the stacker rotation continues, the rising portions 28 raise the tag.

Figure 2:
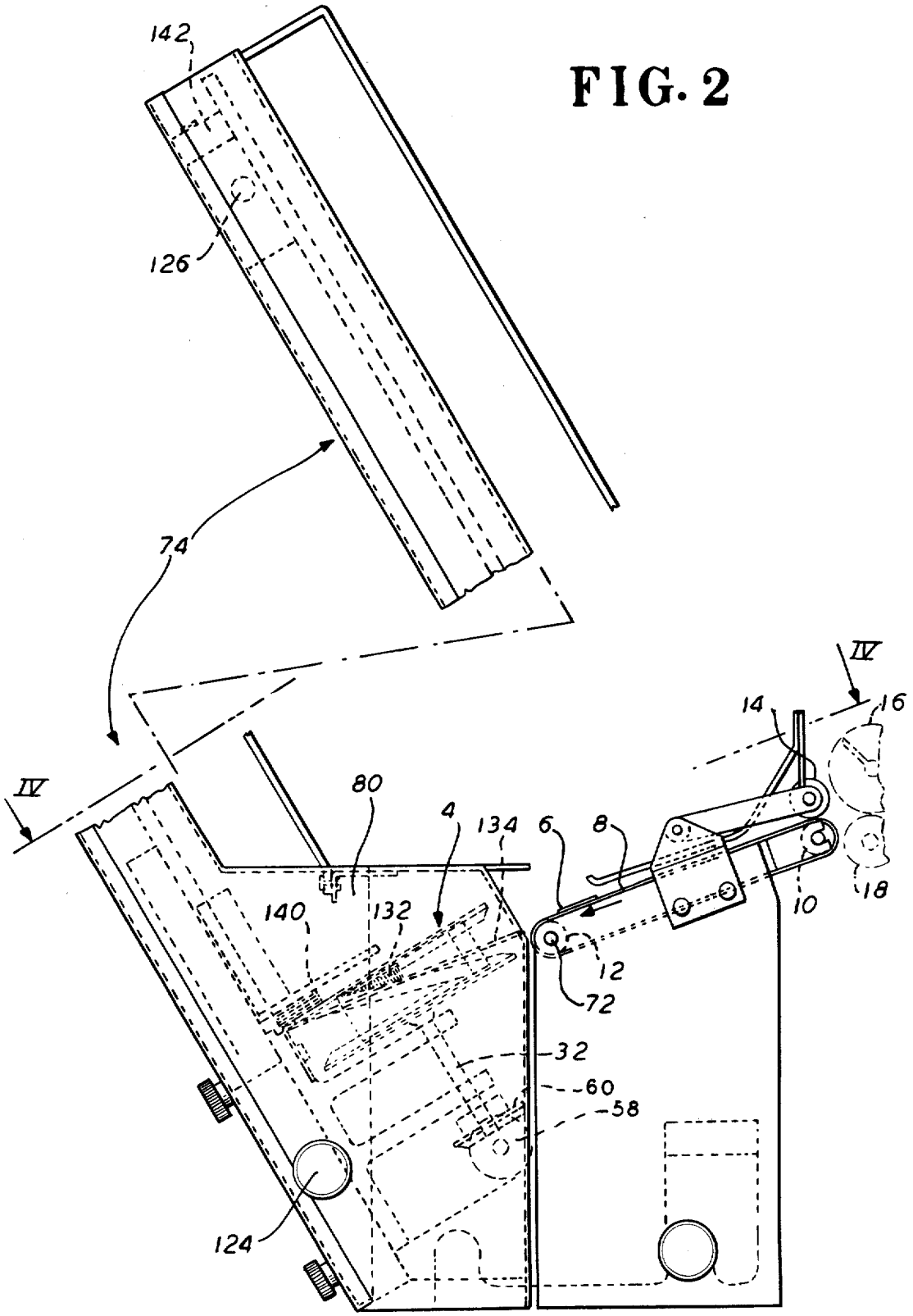
FIG. 2 is a left side elevational view of the tag stacking device and tag hopper.

Near the end of this vertical movement of the tag, gripping means of the helical stacking members 2, 4 will automatically engage the tag at the latter's opposed end portions, and thrust the tag toward the rear into engagement with surface 92 of the hopper back wall 76 to align the tags in a front to back direction. For this purpose, there is provided on the underside of the upper end of each stacking member's annulus 22 a resilient depending gripping means effective to grip or clamp the tag between itself and the underlying intermediate helix portion 28. This gripping means is preferably in the form of a brush 132 secured to the uppermost, free end portion of band 22 and having depending bristles. As best seen in FIGS. 1, 2, and 3, the bristles extend downwardly toward and against the upper surface of the underlying rising intermediate helix portion 28. As the helical members 2, 4 rotate, when the brush portion 132 and the underlying intermediate helix portion 28 contacted by the brush rotate into vertical alignment and contact with tag 6 at the latter's opposed ends, the tag will thus be frictionally gripped between the brush bristles and intermediate helix portion 28. As the stacker rotation continues, the gripping brush portions will rotate inwardly and rearwardly, i.e., toward the back wall 76 of the tag hopper 74, and will consequently pull the tag rearwardly therewith into engagement with the aforesaid rear wall. The continued stacker rotation will merely drag the brush bristles harmlessly away from the tag across the face of the tag, the tag being held stationary against any further rearward movement by the hopper rear wall, while the helical stacking members continue their uninterrupted rotary movement for repetition of the foregoing operations with the next tag.

Other forms of gripping means can also be used, such as a resilient spring steel finger mounted on the underside of the free end of each helix band 22 and resiliently contacting the underlying intermediate helix portion 28. However, the aforedescribed brush 132 is preferred as the gripping means especially when the stacker is used with the tag printing machine of Ser. No. 901,869. In the latter, the printed tags may have some loose unfixed toner particles on them. The bristles of brush 132 are less likely to smear such unfixed toner, because the gripping forces applied by the brush bristles is spread out over a larger area and a larger number of contact points.

As successive tags go through the aforedescribed stacking operation, the tag stack in the hopper is thus formed by each successive tag being fed into the bottom of the stack, the stack being held up by the uppermost circular, planar portions 24 of the helical member annular band 22.

In a preferred embodiment of the invention, the tag transport belts 8 feed the tags at a linear speed of 1688 inches per second, the outer diameter of each helical stacker member 2, 4 is about $3\frac{3}{4}$ inches, and the helical stacker members rotate at 300 rpm.

If any tag 6 should arrive at or be moving on the helical stacking members 2, 4 in a skewed orientation, there is the possible danger that either end of the tag could fall below the uppermost intended tag-contacting surfaces of annular band 22. To prevent this from happening, there is provided between the helical stacker members 2, 4 a stationary guide ramp 134 fastened at its left end to the central stationary hopper rear wall 76. Ramp 134 extends between the helical stacker members 2 and 4. Ramp 134 is of a larger width at its ends but narrows down arcuately towards its central portion to provide clearance between itself and the helical stacker members. As best seen in FIG. 3, the ramp's right end is located a short distance above the base of the helical stacker members, and it slopes rearwardly and upwardly (relative to the stackers' rotational axes) to a point substantially coplanar with the stacker members' top planes. Depending on the dynamics of the high speed movement of any particular tag, upon leaving the transport belts 8 the tag will either first engage ramp 134 and then be picked up by the helical stacker members, or it may move directly into contact with the latter.

There are also provided side guides to guide and block the tags against undesired front-back movement while they are being operated on by the stacker. Side guides 136, 138 are vertically extending essentially rectangular plates respectively fast with the laterally adjustable side walls 78, 80. Thus, adjustment of the side wall spacing for different widths of tags also causes automatic corresponding adjustment of the distance between the side guides. Side guides 136, 138 lie within the respective helical stacker members 2 and 4. This arrangement is feasible because of the open annular construction of the latter. That is to say, the helical stacker members are each defined by its annular band 22, there being thus an open volume within the confines of the band and it is here that the side guides 136, 138 are disposed.

A stack weight 140 guided for vertical movement in central slot 86 of hopper back wall 76 keeps the tag stack compressed, and also prevents the first few tags leaving the stacker from being thrown into random non-aligned positions. As the stack height rises, weight 140 will eventually engage a contact switch 142 at the top of the hopper 74 thus shutting the machine off.

As mentioned earlier, the stacker is effective to operate with not only a single part tag 6 as shown in the present drawings, but also with two, three, and even more part tags, i.e., documents of greater length as measured in the direction of tag feeding movement of transport belts 8.

Numerous modifications and variants can be made in the invention without departing from its principles and features. Accordingly, it is intended that the foregoing disclosure of a specific embodiment of the invention be illustrative only and not limitative of the following claims.

I claim:

1. A document stacking device for stacking documents comprising:

a document stacker member mounted for rotation about an axis of rotation; and means for rotating said stacker member about said axis of rotation;

said stacker member including a portion extending obliquely to said axis of rotation and effective upon rotation of said stacker member to move said documents along the direction of said axis of rotation;

said stacking device including means for gripping said documents and moving them in a given direction away from said said stacker member;

said given direction extending transversely to said axis of rotation;

said gripping means being mounted on said stacker member and contacting said obliquely extending portion, whereby said documents are gripped between said gripping means and said obliquely extending portion.

2. The combination according to claim 1, wherein:

said gripping means comprises brush means.

3. The combination according to claim 1, wherein:

said stacker member is a helical member, said obliquely extending portion thereof comprising substantially a helix portion.

4. The combination according to claim 3, wherein:

said stacker member comprises an open annular band.

5. The combination according to claim 4, wherein:

said stacker member further comprises a bottom plate on which said annular band is mounted.

6. The combination according to claim 4, including:

stationary guide means for guiding said documents for movement in said given direction;

said guide means being surrounded by said annular band.

7. The combination according to claim 6, wherein:

said guide means comprises a guide plate.

8. The combination according to claim 4, including:

stationary support means adjacent said stacker member for preventing said documents from inadvertently falling under said helix portion of said stacker member.

9. The combination according to claim 8, wherein:

said stationary support means comprises a sloping ramp disposed alongside said stacker member.

* * * * *